US008041259B2

(12) United States Patent
Narita et al.

(10) Patent No.: US 8,041,259 B2
(45) Date of Patent: Oct. 18, 2011

(54) CONDUCTIVE MEMBER, PROCESS CARTRIDGE INCLUDING SAME, AND IMAGE FORMING APPARATUS INCLUDING THE PROCESS CARTRIDGE

(75) Inventors: Yutaka Narita, Sagamihara (JP); Makoto Nakamura, Ebina (JP); Taisuke Tokuwaki, Sagamihara (JP); Tadaaki Hattori, Madano (JP); Tadayuki Oshima, Atsugi (JP); Hiroki Furubayashi, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 707 days.

(21) Appl. No.: 12/149,913

(22) Filed: May 9, 2008

(65) Prior Publication Data

US 2008/0279588 A1 Nov. 13, 2008

(30) Foreign Application Priority Data

May 11, 2007 (JP) ..... 2007-127130

(51) Int. Cl.
*G03G 21/18* (2006.01)

(52) U.S. Cl. ..... 399/115; 399/168; 399/174; 399/176

(58) Field of Classification Search ..... 399/115, 399/168, 174, 176
See application file for complete search history.

(56) References Cited

U.S. PATENT DOCUMENTS

2006/0270541 A1* 11/2006 Narita et al. ..... 492/47

FOREIGN PATENT DOCUMENTS

| | | |
|---|---|---|
| JP | 63-149668 | 6/1988 |
| JP | 01-267667 | 10/1989 |
| JP | 03-240076 | 10/1991 |
| JP | 04-358175 | 12/1992 |
| JP | 2002-139893 | 5/2002 |
| JP | 2004-354477 | 12/2004 |
| JP | 2005-017625 | 1/2005 |
| JP | 2005-091818 | 4/2005 |
| JP | 2005-266774 | 9/2005 |
| JP | 2006-078967 | 3/2006 |
| JP | 3844658 | 8/2006 |
| JP | 2006-330483 | 12/2006 |

OTHER PUBLICATIONS

Abstract of JP 2001-296723 published Oct. 26, 2001.
Search Report dated Aug. 8, 2008 for counter part European Application No. 08251557.8-2209.

* cited by examiner

*Primary Examiner* — David Gray
*Assistant Examiner* — Barnabas Fekete
(74) *Attorney, Agent, or Firm* — Harness, Dickey & Pierce, P.L.C.

(57) ABSTRACT

A conductive member includes a conductive supporting member provided facing an image bearing member and including a continuous or discontinuous fixing groove provided in the vicinity of each of both ends of the conductive supporting member in a peripheral direction thereof, an electrical resistance adjusting layer formed on the conductive supporting member and including a step portion which includes at least one step disposed in the vicinity of each of the both ends of the electrical resistance adjusting member, and gap retainers each provided to the step portion and including a cylinder portion which contacts at least one surface of the step portion, and an end plate so that a predetermined gap is formed between the image bearing member and the electrical resistance adjusting layer. The end plate contacts at least one surface of the step portion and fits into the fixing groove.

14 Claims, 8 Drawing Sheets

FIG. 13

| | NORMAL ROOM AMBIENT (mm) | | FLUCTUATION AMOUNT AMONG THREE DIFFERENT EVALUATION CONDITIONS | | EVALUATION |
|---|---|---|---|---|---|
| | LENGTH OF CHARGING MEMBER (mm) | GAP AMOUNT BETWEEN CHARGING MEMBER AND IMAGE BEARING MEMBER | LENGTH(mm) | GAP(mm) | |
| EXEMPLARY EMBODIMENT 1 | 332.0 | 0.05±0.009 | 0.1 OR LESS | 0.006 | GOOD |
| EXEMPLARY EMBODIMENT 2 | 332.0 | 0.05±0.008 | 0.1 OR LESS | 0.008 | GOOD |
| EXEMPLARY EMBODIMENT 3 | 332.0 | 0.05±0.008 | 0.1 OR LESS | 0.010 | GOOD |
| EXEMPLARY EMBODIMENT 4 | 332.0 | 0.05±0.008 | 0.1 OR LESS | 0.008 | GOOD |
| COMPARATIVE EXAMPLE 1 | 332.0 | 0.05±0.030 | 0.2 | 0.023 | BAD |
| COMPARATIVE EXAMPLE 2 | 332.0 | 0.05±0.020 | 0.2 | 0.025 | BAD |
| COMPARATIVE EXAMPLE 3 | 332.0 | 0.05±0.012 | 1.4 | 0.030 | BAD |

FIG. 14

| | INITIAL IMAGE | GAP AMOUNT BETWEEN CHARGING MEMBER AND IMAGE BEARING MEMBER AFTER 600,000 SHEETS PASSED | ADHERENCE OF TONER TO CHARGING MEMBER SURFACE AFTER 600,000 SHEETS PASSED | IMAGE AFTER 600,000 SHEETS PASSED | EVALUATION |
|---|---|---|---|---|---|
| EXEMPLARY EMBODIMENT 1 | GOOD | 0.05±0.011 | NO TONER FIRMLY ADHERED. | GOOD | GOOD |
| EXEMPLARY EMBODIMENT 2 | GOOD | 0.05±0.010 | NO TONER FIRMLY ADHERED. | GOOD | GOOD |
| EXEMPLAR EMBODIMENT 3 | GOOD | 0.05±0.010 | NO TONER FIRMLY ADHERED. | GOOD | GOOD |
| EXEMPLARY EMBODIMENT 4 | GOOD | 0.05±0.011 | NO TONER FIRMLY ADHERED. | GOOD | GOOD |
| COMPARATIVE EXAMPLE 1 | UNEVEN IMAGE WAS FORMED. | 0.04±0.050 | TONER FIRMLY ADHERED. | UNEVEN IMAGE WAS FORMED. | BAD |
| COMPARATIVE EXAMPLE 2 | GOOD | 0.03±0.040 | TONER FIRMLY ADHERED. | UNEVEN IMAGE WAS FORMED. | BAD |
| COMPARATIVE EXAMPLE 3 | GOOD | 0.05±0.015 | TONER FIRMLY ADHERED. | UNEVEN IMAGE WAS FORMED. | BAD |

CONDUCTIVE MEMBER, PROCESS CARTRIDGE INCLUDING SAME, AND IMAGE FORMING APPARATUS INCLUDING THE PROCESS CARTRIDGE

CROSS-REFERENCE TO RELATED APPLICATIONS

This patent application is based on and claims priority pursuant to 35 U.S.C. §119 from Japanese Patent Application No. 2007-127130 filed on May 11, 2007 in the Japan Patent Office, the entire contents of which are hereby incorporated herein by reference.

BACKGROUND OF THE INVENTION

1. Field of the Invention

Exemplary aspects of the present invention generally relate to a conductive member, a process cartridge including the conductive member, and an image forming apparatus using the process cartridge.

2. Description of the Background Art

Conventionally, in image forming apparatuses such as a laser printer, a facsimile, or the like using an electrophotographic technique, a conductive member is used for a charging roller serving as a charging member for charging an image bearing member (hereinafter also referred to as a photoreceptor), and a transfer roller serving as a transfer member for transferring a toner image onto the image bearing member to a recording medium.

FIG. 1 illustrates one example of a related art image forming apparatus 300 using the electrophotographic technique. The related art image forming apparatus includes at least an image bearing member 211 on which an electrostatic latent image is formed; a charging roller 212 for charging the image bearing member 211 by abutting the image bearing member 211; a laser beam 213 serving as an exposure mechanism; a developing unit 220 including a toner bearing member (a developing roller) 214 for adhering toner 215 to the electrostatic latent image on the image bearing member 211; a transfer member (transfer roller) 216 for transferring the toner image on the image bearing member 211 to a recording medium 217; and a cleaning unit 221 including a cleaning member (a cleaning blade), 218 for cleaning the surface of the image bearing member 211 after transfer processing. In FIG. 1, reference numeral 219 denotes waste toner.

As illustrated in FIG. 1, in the related art image forming apparatus 300, the charging roller 212 charges an image bearing member 211 while abutting the photoreceptor 211. When a direct current (DC) voltage is applied to the charging roller 212 in contact with the image bearing member 211 from a power source, not shown, the surface of the image bearing member 211 is uniformly charged. Immediately after that, when the surface of the image bearing member 211 is irradiated with the laser beam 213 in accordance with image data, an electrical potential (hereinafter "potential") of the irradiated portion of the image bearing member 211 is reduced. In such a charging mechanism, in which the surface of the image bearing member 211 is charged by the charging roller 212, it is known that there is discharge across a tiny gap between the charging roller 212 and the image bearing member according to Paschen's law.

When the surface of the image bearing member 211 is irradiated with the laser beam, a potential distribution according to the image is formed thereon, that is, the electrostatic latent image is formed on the image bearing member 211. When the portion of the image bearing member 211 on which the electrostatic latent image is formed passes the developing roller 214, the toner 215 adheres to the electrostatic latent image in accordance with the potential, thereby forming a visible image, that is, a toner image.

The recording medium 217 is transported to the portion of the image bearing member 211 on which the toner image is formed, and the toner image is transferred onto the recording medium 217 by the transfer roller 216. Subsequently, the recording medium 217 is separated from the image bearing member 211. The recording medium 217 is transported through a conveyance path, thermally fixed by a fixing unit (not shown), and discharged outside the image forming apparatus.

After such transfer processing is completed, the surface of the image bearing member 211 is cleaned by the cleaning blade 218 of the cleaning unit 221. Furthermore, a quenching lamp, not shown, removes residual charge so as to prepare the image bearing member for the subsequent image forming processing.

Japanese Patent Laid-Open Application Publication No. Sho 63-149668 and Japanese Patent Laid-Open Application Publication No. Hei 01-267667 disclose a contact-type charging method using the known charging roller described above. In the contact-type charging method, the charging roller is configured to charge the image bearing member by contacting the image bearing member. However, such a contact-type charging method has the following drawbacks.

A substance constituting the charging roller may seep out from the charging roller and transfer to the surface of the device to charge, for example, the image bearing member, leaving marks, or so-called "traces of charge roller", on the surface of the device to charge.

Furthermore, when an alternating current (AC) voltage is applied to the charging roller, the charging roller in contact with the image bearing member may vibrate. Consequently, there is a possibility that noise is generated.

Moreover, toner on the image bearing member may adhere to the charging roller. In particular, due to the substance seeping out from the charging roller, the toner is more likely to stick to the charging roller. Thus, the charging ability of the charging roller may deteriorate.

Yet further, when the material constituting the charging roller sticks to the image bearing member, and the image bearing member is not in operation for an extended period of time, permanent deformation of the charging roller may occur.

In an attempt to solve problems of this kind, Japanese Patent Laid-Open Application Publication No. Hei 03-240076 and Japanese Patent Laid-Open Application Publication No. Hei 04-358175 disclose a non-contact type charger. In such a non-contact type charger, a charging roller is disposed across from the image bearing member such that a gap, or the closest distance between the charging roller and the image bearing member, is configured to be in a range of from 50 μm to 300 μm, for example. When the charging roller is supplied with voltage, the charging roller can charge the image bearing member.

In such a non-contact type charger, the charging roller and the image bearing member are not in contact with each other, thereby preventing such problems as adherence of the substance composing the charging roller to the image bearing member surface and permanent deformation of the image bearing member described above.

Furthermore, in the non-contact type charger, a smaller amount of toner sticks to the charging roller to begin with, and therefore a smaller amount of toner and the like on the image bearing member sticks to the charging roller.

The non-contact type chargers disclosed in Japanese Patent Laid-Open Application Publication No. Hei 03-240076 and Japanese Patent Laid-Open Application Publication No. Hei 04-358175 are provided with a spacer ring attached at both ends of the charging roller so that a predetermined gap is secured between the charging roller and the image bearing member.

However, according to non-contact type chargers of this type, precise control of the size of the gap is difficult to achieve. Thus, there is a problem such that when the dimensional accuracy of the charging roller and the spacer rings varies, the size of the gap between the charging roller and the image bearing member may fluctuate. As a result, the charge potential of the image bearing member may fluctuate, which is undesirable. Therefore, the main challenge facing such non-contact type chargers is how to maintain a constant gap between the charging roller and the image bearing member so as to ensure a consistent charge to the image bearing member.

In an attempt to solve the above-described problem, Japanese Patent Laid-Open Application Publication No. 2002-139893 discloses a tape-type gap retainer designed to maintain a constant gap between the charging roller and the image bearing member even as the ambient temperature and humidity fluctuates. However, when the charger having the tape-type gap retainer is in use for an extended period of time, there may be a problem such that the tape-type gap retainer is worn out. Furthermore, toner may advance into a space between the charging roller and the tape-type gap retainer, and firmly stick therebetween due to an adhesive agent seeping out from the tape-type gap retainer. As a result, a constant gap between the surface of the image bearing member and the charging roller may not be consistently maintained.

In yet another attempt to solve the above-described problem, Japanese Patent Laid-Open Application Publication 2004-354477 discloses a charging member (a charging roller) including a gap retainer provided at both ends of an electrical resistance adjusting layer.

Referring now to FIG. 2, there is provided a cross-sectional view illustrating the related art charging member (a charging roller). As illustrated in FIG. 2, a charging member (charging roller) 310 includes a conductive supporting member 301, an electrical resistance adjusting layer 302 formed on the conductive member 301, and a spacer 305 serving as a gap retainer and provided at both ends of the electrical resistance adjusting layer 302.

The spacers 305 are formed of thermoplastic resin having a durometer hardness in the range of from HDD 30 to HDD 70, and a mass loss of no more than 10 mg/1000 cycles using Taber Abraser.

Each spacer 305 of the charger 310 of this type is press-fitted onto both end portions of the electrical resistance adjusting layer 302. Accordingly, the spacer 305 is formed at both ends of the electrical resistance adjusting layer 302 and abuts the conductive supporting member 301. Moreover, recently, the electrical resistance adjusting layer 302 and the spacers 305 are processed substantially simultaneously, that is, are cut and ground substantially simultaneously in a single continuous process, and therefore it is possible for the spacer of this type to enhance reliability and accurately control the size of the gap.

In the charging member 310, the spacers 305 (the gap retainers) and the electrical resistance adjusting layer 302 are formed of different material in consideration of toner adhesion characteristics. An ion-conductive agent is used as an electrical resistance adjusting agent of the electrical resistance adjusting layer 302, and thus the water absorption of the electrical resistance adjusting layer 302 is high. Consequently, under high-temperature and high-humidity conditions, the electrical resistance adjusting layer 302 may absorb moisture, causing the dimensions of the electrical resistance adjusting layer to fluctuate.

Since the spacers 305 of the charging member 310 are formed of material including an olefin-based resin, insulating characteristics of the spacers 305 and resistance against toner adherence are enhanced. However, an amount of dimensional fluctuation of the spacers 305 under high-temperature and high-humidity conditions is less than that of the electrical resistance adjusting layer 302. As a result, there may be a problem such that the size of the gap G (illustrated in FIG. 12) formed with such high precision between the charger 310 and the image bearing member may fluctuate when ambient conditions change.

As illustrated in FIG. 3, in an attempt to solve the above-described problems, Japanese Patent Laid-Open Application Publication 2006-78967 discloses a conductive member 410 including a conductive supporting member 401, an electrical resistance adjusting layer 402 formed on the conductive supporting member 401, and a gap retainer 405 provided at both ends of the electrical resistance adjusting layer 402.

The conductive member 410 includes a continuous or a discontinuous fixing groove 401*a* formed on an outer surface of the conductive supporting member 401 in a peripheral direction facing the electrical resistance adjusting layer 402 and/or the gap retainer 405, and a continuous or discontinuous protrusion 402*b* formed on an inner surface of the electrical resistance adjusting layer 402 and/or the gap retainer 405 in the peripheral direction such that the protrusion 402*b* is fitted into the fixing groove 401*a*.

When the protrusion 402*b* is provided on the inner surface of the gap retainer 405 in the peripheral direction, the protrusion 402*b* can be fitted into the fixing groove 401*a*, thereby preventing the gap retainer 405 from shifting toward the shaft direction due to changes in the dimension of the electrical resistance adjusting layer 405. Accordingly, the gap fluctuation due to changes in ambient conditions can be reduced.

However, an amount of contraction caused by residual stress at a place of the gap retainer 405 where the protrusion 402*b* is provided differs from a place of the gap retainer 405 where no protrusion is provided. Consequently, there may be a problem such that the shape of the surface of the gap retainer 405 contacting the image bearing member may be uneven, and the changes in ambient conditions may cause the gap size to fluctuate.

Furthermore, it may be difficult to appropriately position the protrusion 402*b* provided to the gap retainer 405 so as to fit into the fixing groove 401*a*, and also confirm the fitting position of the protrusion 402*b* in the fixing groove 401*a*. Consequently, some experience and skill may be required to position the protrusion 402*b* at an appropriate position so that the protrusion 402*b* is fitted into the fixing groove 401*a* correctly.

FIG. 4 is a cross-sectional view of another related-art charging member. As illustrated in FIG. 4, Japanese Patent Laid-Open Application Publication 2006-330483 discloses a conductive member 510 including a long-length conductive supporting member 501, an electrical resistance adjusting layer 502 formed on the conductive supporting member 501, and a cap-like gap retainer 505 provided at both ends of the electrical resistance adjusting layer 502.

The electrical resistance adjusting layer 502 includes a step portion having at least one step provided at both ends of the electrical resistance adjusting layer 502 in the direction of both ends. The gap retainer 505 is fixed at both ends of the electrical resistance adjusting layer 502 such that the gap retainer 505 contacts at least two surfaces constituting the step portion. A difference in height relative to an outer circumferential surface of the electrical resistance adjusting layer 502 is formed in an outer circumferential surface of each gap retainer 505 such that a certain gap G is formed between the outer circumferential surface of the image bearing member and the outer circumferential surface of the electrical resistance adjusting layer 502 (see G in FIG. 9.)

The conductive member of this kind enables the surface of the image bearing member to be charged without generating abnormal discharge by preventing deformation of the gap retainer due to the peeling of the end portions thereof during cutting of the surface of the gap retainer.

However, similar to the related art disclosed in Japanese Patent Laid-Open Application Publication 2004-354477, there may be a problem such that changes in ambient conditions may cause the dimension of the electrical resistance adjusting layer to change so that the gap retainer may shift in the shaft direction, resulting in the fluctuation of the size of the gap between the charging member and the image bearing member.

SUMMARY OF THE INVENTION

In view of the foregoing, exemplary embodiments of the present invention provide a conductive member, a process cartridge including the same, and an image forming apparatus including the process cartridge, which can maintain a gap between an image bearing member and a conductive member, i.e. a charging roller, even after an extended period of use.

In one exemplary embodiment, a conductive member may include a conductive supporting member, an electrical resistance adjusting layer, and gap retainers. The conductive supporting member is provided facing an image bearing member and includes a continuous or discontinuous fixing groove provided in the vicinity of each of both ends of the conductive supporting member in a peripheral direction thereof. The electrical resistance adjusting layer is formed on the conductive supporting member and includes a step portion including at least one step disposed in the vicinity of each of the both ends of the electrical resistance adjusting member. The gap retainers are each provided to the step portion and include a cylinder portion and an end plate.

The cylinder portion contacts at least one surface of the step portion. The end plate includes a hole in a substantially center thereof through which the conductive supporting member is inserted, and contacts at least one surface of the step portion and fits into the fixing groove. The conductive member may serve as a charging member.

Each gap retainer is fitted into the step portion such that a difference in height relative to a circumferential surface of the electric resistant adjusting layer is formed in a circumferential surface of the gap retainer, so as to form a predetermined gap between a circumferential surface of the image bearing member and the circumferential surface of the electrical resistance adjusting layer.

Another exemplary embodiment provides a process cartridge including at least an image bearing member, a cleaning unit, and the charging member. The image bearing member is configured to bear an electrostatic latent image on a surface thereof. The cleaning unit is configured to clean toner remaining on the surface of the image bearing member. The charging member is disposed in the vicinity of a device to charge.

Yet another exemplary embodiment provides an image forming apparatus including at least an image bearing member, an exposure unit, a developing unit, a transfer unit, a fixing unit, and the process cartridge. The image bearing member is configured to bear an electrostatic latent image on a surface thereof. The exposure unit is configured to irradiate the image bearing member with a laser beam to form the electrostatic latent image thereon. The developing unit is configured to develop the electrostatic latent image with toner to form a toner image. The transfer unit is configured to transfer the toner image onto a recording medium. The fixing unit is configured to fix the toner image on the recording medium.

Additional features and advantages of the present invention will be more fully apparent from the following detailed description of exemplary embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of exemplary embodiments when considered in connection with the accompanying drawings, wherein:

FIG. 13 is a table showing evaluation results of an amount of fluctuation of a gap between the image bearing member and the conductive member of exemplary embodiments 1 through 4, and comparative examples 1 through 3; and FIG. 14 is a table showing evaluation results of an image, according to the exemplary embodiments 1 through 4, and the comparative examples 1 through 3.

DETAILED DESCRIPTION OF EXEMPLARY EMBODIMENTS

Figure 1:
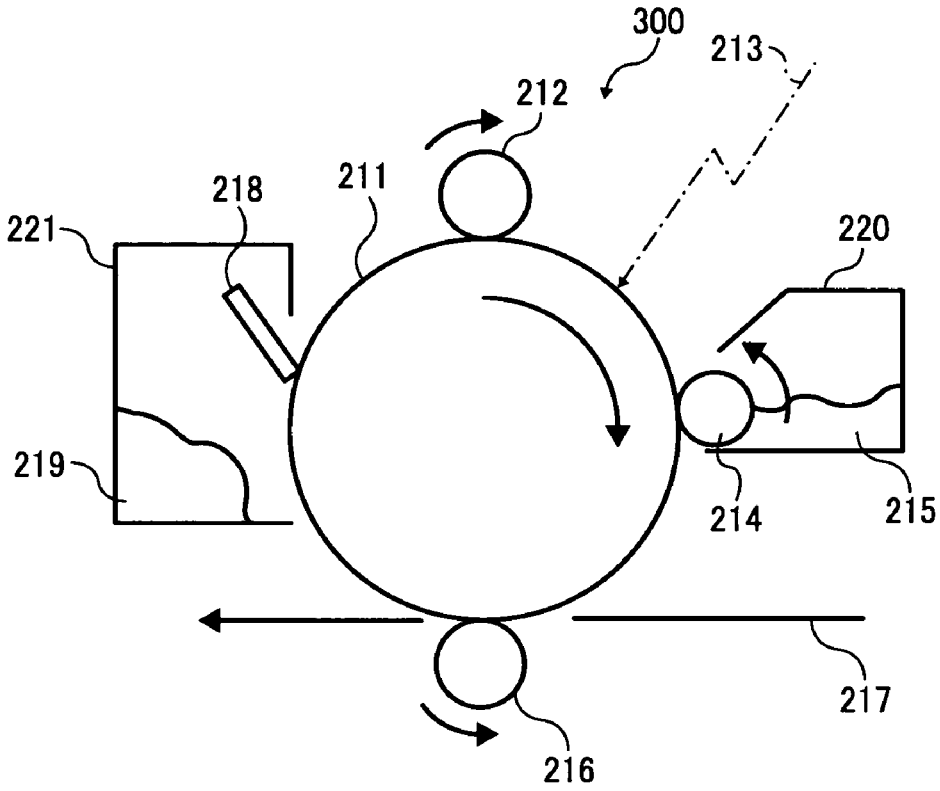
FIG. 1 PRIOR ART
FIG. 1 is a schematic diagram illustrating a related art charging member (charging roller) of an electrophotographic image forming apparatus.

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

In a later described comparative example, exemplary embodiment, and alternative example, for the sake of simplicity of drawings and descriptions, the same reference numerals will be given to constituent elements such as parts and materials having the same functions, and redundant descriptions thereof will be omitted unless otherwise stated.

Typically, but not necessarily, paper is the medium from which is made a sheet on which an image is to be formed. It should be noted, however, that other printable media are available in sheet, and accordingly their use here is included. Thus, solely for simplicity, although this Detailed Description section refers to paper, sheets thereof, paper feeder, etc., it should be understood that the sheets, etc., are not limited only to paper, but includes other printable media as well.

Figure 5:
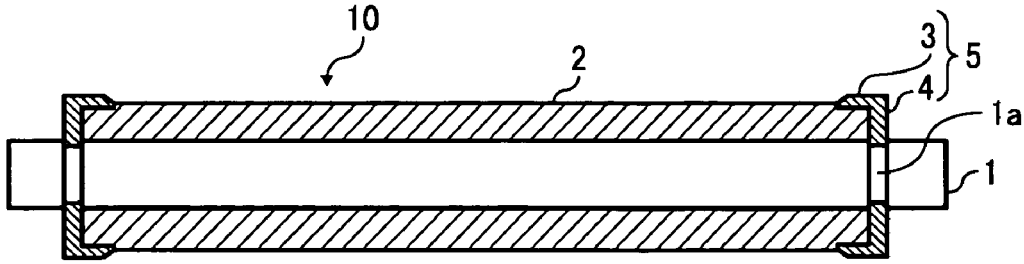
FIG. 5 is a cross-sectional view illustrating a conductive member (charging roller), according to an exemplary embodiment.

Referring now to the drawings, wherein like reference numerals designate identical or corresponding parts throughout the several views, and initially to FIG. 5, one example of a conductive member according to one exemplary embodiment of the present invention is described.

Referring now to FIG. 5, there is provided a cross-sectional view illustrating a conductive member 10 serving as a charging roller according to one exemplary embodiment of the present invention.

Figure 6A:
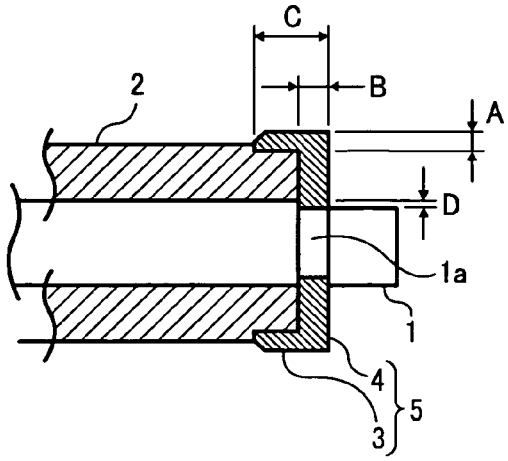
FIG. 6A is an enlarged cross-sectional view illustrating one end portion of the conductive member of FIG. 5, according to an exemplary embodiment.
Figure 6B:
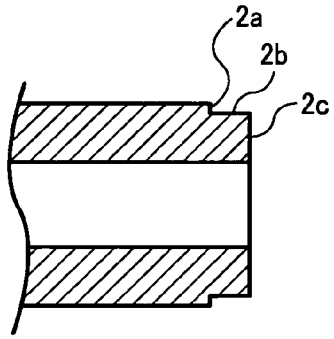
FIG. 6B is an enlarged cross-sectional view illustrating one end portion of an electrical resistance adjusting layer of the conductive member, according to an exemplary embodiment.
Figure 6C:
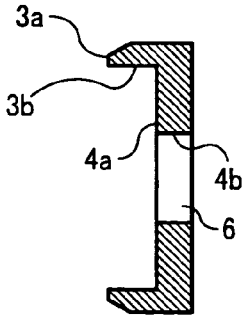
FIG. 6C is an enlarged cross sectional view illustrating a portion of a gap retainer of the conductive member, according to an exemplary embodiment.

FIG. 6A through 6C are partial enlarged cross-sectional views illustrating the conductive member (the charging roller) 10 of FIG. 5. FIG. 6A illustrates a partial enlarged cross-sectional view of one end portion of the conductive member 10. FIG. 6B illustrates a partial cross-sectional view of an electrical resistance adjusting layer 2 constituting the end portion of the conductive member 10. FIG. 6C illustrates a partial enlarged cross-sectional view of a gap retainer 5.

Figure 7:
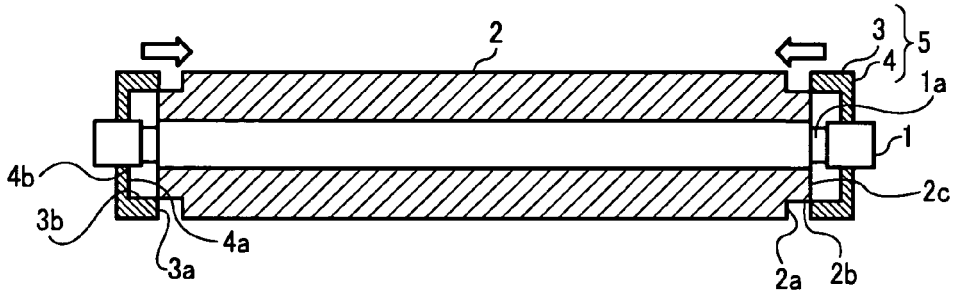
FIG. 7 is an explanatory schematic diagram illustrating a method of installing the electrical resistance adjusting layer and the gap retainer in the conductive member, according to an exemplary embodiment.
Figure 8:
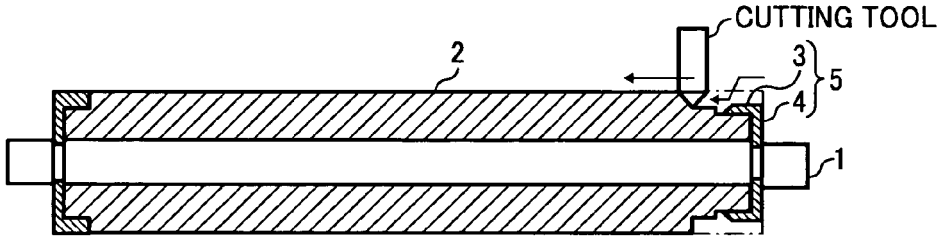
FIG. 8 is an explanatory schematic diagram illustrating cutting of the electrical resistance adjusting layer and the gap retainer, according to an exemplary embodiment.
Figure 9:
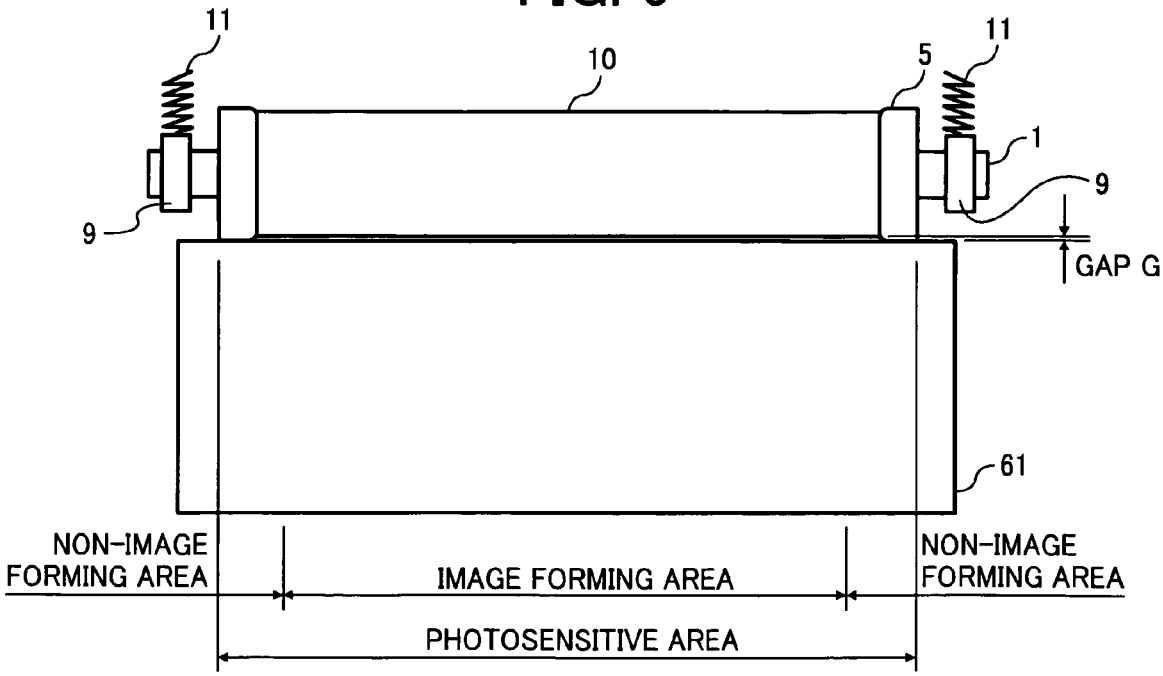
FIG. 9 is an explanatory schematic diagram illustrating the conductive member disposed substantially above an image bearing member.

FIG. 7 is an explanatory diagram illustrating a method of installing the electrical resistance adjusting layer 2 and a gap retainer 5 in the conductive member 10. FIG. 8 is an explanatory diagram illustrating a process of cutting away the surface of the electrical resistance adjusting layer 2 and the gap retainer 5. FIG. 9 is a schematic diagram illustrating the conductive member (charging roller) 10 disposed substantially above the image bearing member 61.

In FIG. 5, the conductive member 10 serving as the charging roller includes at least a long conductive supporting member 1, the electrical resistance adjusting layer 2 provided on the conductive supporting member 1, and the gap retainer 5 having a cap-like shape fitted to both ends of the electrical resistance adjusting layer 2.

As illustrated in FIGS. 6A through 6C and FIG. 9, the conductive member 10 includes at least the conductive supporting member 1 having a continuous or a discontinuous fixing groove 1*a* provided in the vicinity of each end of the conductive supporting member 1 in a peripheral direction. In FIG. 9, reference numeral 9 denotes shaft bearings at both ends of the conductive supporting member 1.

The electrical resistance adjusting layer 2 includes at least one step portion having at least one step, provided in the vicinity of each end of the electrical resistance adjusting layer 2 in the direction of both ends. The step portion includes a lateral surface 2*a*, an end surface 2*c*, and a horizontal surface 2*b*.

As illustrated in FIG. 6A, the gap retainer 5 includes at least a cylinder portion 3 and an end plate 4 provided in such a manner that the gap retainer 5 fits the step of the step portion. The cylinder portion 3 includes a side surface 3*a* and a horizontal surface 3*b*. The end plate 4 includes an inner lateral surface 4*a* and a horizontal surface 4*b*. A hole 6 through which the conductive supporting member 1 is inserted is provided in a substantially center of the end plate 4.

The side surface 3*a*, the horizontal surface 3*b*, and the inner lateral surface 4*a* are configured to contact the lateral surface 2*a*, the horizontal surface 2*b*, and the end surface 2*c*, respectively, of the electrical resistance adjusting layer 2. The gap retainer 5 is attached to the electrical resistance adjusting layer 2 such that the horizontal surface 4*b* forming the insertion hole 6 of the end plate 4 of the gap retainer 5 fits into the fixing groove 1*a*, and a difference in height is formed relative to the circumferential surface of the electrical resistance adjusting layer 2.

Accordingly, when the circumferential surface of the gap retainer 5 contacts the image bearing member 61, a predetermined gap G is formed between the circumferential surface of the image bearing member 61 and the circumferential surface of the electrical resistance adjusting layer 2.

Accordingly, at an initial use and even after a long period of use, it is possible to reduce, if not prevent entirely, fluctuation in the size of the gap G formed between the image bearing member 61 and the conductive member 10. Furthermore, alignment of the end plate 4 of the gap retainer 5 relative to the fixing groove 1*a* of the conductive supporting member 1 can be performed with ease. Still further, the position of the end plate 4 of the gap retainer 5 engaging the fixing groove 1*a* can be visually confirmed.

Since the horizontal surface 4*b* constituting the insertion hole 6 in the substantially center of the end plate 4 of the gap retainer 5 contacts the fixing groove 1*a*, torque resistance can be further enhanced compared to the related art technologies, thereby avoiding a phase shift.

According to the exemplary embodiment, the cylinder portion 3 of the gap retainer 5 is press-fitted onto the step of the step portion of the electrical resistance adjusting layer 2. With this structure, even if a precision of the fit between the step portion of the electrical resistance adjusting layer 2 and the gap retainer 5 is reduced to some degree, the gap retainer 5 can be secured for an extended period of time by the bonding force between the resins.

Furthermore, when the cutting illustrated in FIG. 8 is performed substantially simultaneously on the electrical resistance adjusting layer 2 and the gap retainer 5 in a single continuous process, positional-displacement including rotation of the gap retainer 5 during cutting can be prevented.

It is preferable that the gap retainer 5 be fixed to the electrical resistance adjusting layer 2 and/or the conductive supporting member 1 by an adhesive agent. Accordingly, in addition to the bonding force between the resins, the adhesive force of the adhesive agent further enhances bonding force between the gap retainer 5 and the electrical resistance adjusting layer 2 and/or the conductive supporting member 1 for an extended period of time, thereby reducing if not preventing entirely displacement of the gap retainer 5 even if the precision of the fit between the step portion and the gap retainer 5 deteriorates to some degree.

Still further, when the electrical resistance adjusting layer 2 and the gap retainer 5 are cut together, positional displacement including rotation of the gap retainer 5 during cutting can be prevented.

It is preferable that the gap retainer 5 be fixed to the electrical resistance adjusting layer 2 and/or the conductive supporting member 1 by an adhesive agent through a primer applied to the gap retainer 5. Accordingly, the active component of the primer including a polar and a non-polar component permeates the gap retainer 5, and is oriented, thereby modifying the adhesive surface of the gap retainer. As a result, even if the precision of the fit between the step portion and the gap retainer 5 is deteriorated to some degree, the bonding force between the resins, and the adhesive force of the adhesion through the primer further enhance bonding between the gap retainer 5 and the electrical resistance adjusting layer 2 and/or the conductive supporting member 1 for an extended period of time, thereby reducing, if not preventing entirely, displacement of the gap retainer 5.

Still further, when the electrical resistance adjusting layer 2 and the gap retainer 5 are cut substantially simultaneously in a single continuous process, positional displacement including rotation of the gap retainer 5 during cutting can be prevented.

It is preferable that at least the portion of the gap retainer 5 which contacts the image bearing member 61 is formed of material including an electrically insulating resin. A volume resistivity of the gap retainer 5 is preferably no less than $10^{13}$ Ω·cm. Accordingly, when the conductive member 10 is supplied with a high voltage, generation of abnormal discharge, for example, a leak current between the gap retainer 5 and the base layer of the image bearing member 61, can be reduced, if not prevented entirely.

According to the exemplary embodiment, in order to consistently provide the substantially small gap G between the image bearing member 61 and the circumferential surface of the electrical resistance adjusting layer 2 for an extended period of time, it is preferable that the material that constitutes the gap retainer 5 have little absorbability and good durability.

Furthermore, it is preferable that the material of the gap retainer 5 prevent the toner and additives added to the toner from sticking to the surface of the electrical resistance adjusting layer 2.

Since the gap retainer 5 rotates while abutting the image bearing member 61, it is also important that the material of the gap retainer 5 does not wear out the surface of the image bearing member 61. Thus, the material of the gap retainer 5 may be, but is not limited to, for example, polyethylene (PE), polypropylene (PP), polyacetal (POM), polymethylmethacrylate (PMMA), polystyrene (PS), copolymers thereof (such as AS and ABS), and other such widely used resins, and polycarbonate (PC), urethane, and polytetrafluoroethylene (PTFE). The gap retainer 5 may be fabricated by a molding process.

The electrical resistance adjusting layer 2 is formed of a thermoplastic resin composition including macromolecular ionic conductive material. It is preferable that a macromolecular compound including a polyetheresteramide component is used as the macromolecular ionic conductive material. Polyetheresteramide is ionic conductive macromolecular material so that polyetheresteramide can be evenly dispersed in matrix polymer on the molecular level and fixed. Therefore, variations in the resistance value due to disperse failure, as can be seen in a composition in which an electron conductive agent such as metal oxide, carbon black or the like is dispersed, do not occur.

Furthermore, since polyetheresteramide is macromolecular ionic conductive material, leakage to the image bearing member and bleed-out to the surface thereof do not easily occur.

A volume resistivity of the electrical resistance adjusting layer 2 of greater than $10^9$ Ω·cm results in an insufficient charge, making it difficult to obtain a sufficient charging potential to obtain a uniform image. On the other hand, when the volume resistivity is less than $10^6$ Ω·cm, voltage concentration (leak) and abnormal discharge into a defective portion of the image bearing member 61 may occur.

Therefore, according to the exemplary embodiment, the volume resistivity of the electrical resistance adjusting layer 2 is preferably in a range of from $10^6$ Ω·cm to $10^9$ Ω·cm, to ensure sufficient charging of the image bearing member and transfer of the image and to reduce if not prevent entirely voltage concentration and abnormal discharge into the image bearing member.

Alternatively, the electrical resistance adjusting layer 2 may be formed of a combination of insulating thermoplastic resin and macromolecular ionic conductive material. However, the thermoplastic resin is not limited to the resins described above, and consequently the thermoplastic resin may be polyethylene, polypropylene, polymethylmethacrylate, polystyrene (PS), copolymers thereof, or other such widely used resins, or engineering plastics such as polycarbonate, polyacetal or the like.

With respect to the blending ratio, when the ratio of the insulating thermoplastic resin is 0 to 70 wt %, the ratio of macromolecular ionic conductive material is 30 to 100 wt % so that the desired volume resistivity can be obtained. Furthermore, in order to adjust the resistivity, an electrolyte (salt) may be added thereto. Specific preferred examples of the salt include alkali metal salts such as sodium perchlorate and lithium perchlorate, and quaternary phosphonium salts such as ethyltriphenylphosphoniumtetrafluoroborate and tetraphenylphosphoniumbromide.

One or more conductive agents may be blended unless the desired properties are impaired. In order to uniformly disperse the conductive material on the molecular level in the matrix polymer, it is possible to use, as a compatibilizing agent, graft copolymer having an affinity for both the insulating thermoplastic resin compound and the macromolecular ionic conductive material.

When the electrical resistance adjusting layer 2 is too thin, abnormal discharge may occur due to leakage. On the other hand, when it is too thick, it is difficult to maintain surficial accuracy. Therefore, it is preferable that the thickness of the electrical resistance adjusting layer 2 be at least 100 μm but not more than 500 μm.

There are no particular restrictions on the method of manufacturing the above-described thermoplastic resin composition. Thus, for example, the thermoplastic resin composition can be made with ease by melting and kneading a mixture of materials in a dual-shaft mixer, kneader, or the like.

The electrical resistance adjusting layer 2 may be formed on the circumferential surface of the conductive supporting layer 1 with ease by coating the conductive supporting member 1 with the thermoplastic resin composition by extrusion molding, ejection molding, or the like. In a process in which a cylindrical thermoplastic resin composition formed by the extrusion molding is press-fitted to the conductive supporting member 1, the electrical resistance adjusting layer 2 can be made thin and highly accurately provided.

As illustrated in FIG. 5, the conductive member (the charging member) 10 includes the cap-shape gap retainer 5 at each end of the electrical resistance adjusting layer 2 formed on the conductive supporting member 1. According to the exemplary embodiment described above, the conductive member 10 has a cylindrical shape. However, the shape of the conductive member 10 is not specifically limited thereto. Thus, the conducive member 10 may be in the form of a belt, a blade (plate), or a semicircular cylinder. In addition, both ends of the conductive member 10 may be rotatively held by a gear or a shaft.

When the conductive member 10 has a curved surface that gradually separates from the most approximate position from upstream from the image bearing member 61 to downstream thereof in the direction of movement of the image bearing member 61, the image bearing member 61 can be uniformly charged. By contrast, when the conductive member 10 facing the image bearing member 61 has an acute portion, the potential of the acute portion is high so that discharge occurs, making it difficult to uniformly charge the image bearing member 61. Thus, the conductive member 10 has a cylindrical shape and a curved surface.

The surface of the conductive member 10 that discharges is under great stress. When discharge occurs at the same surface repeatedly, deterioration of the surface is promoted. The surface may be scraped off. When an entire surface of the conductive member 10 can be used as a discharging surface, deterioration can be prevented at an early stage of use by rotating the conductive member 10, resulting in extension of the service life of the conductive member 10.

According to the exemplary embodiment described above, the continuous or the discontinuous fixing groove 1*a* is provided in the vicinity of each end of the conductive supporting member 1 in the peripheral direction. The electrical resistance adjusting layer 2 includes at least one step portion having at least one step, provided in the vicinity of each end of the electrical resistance adjusting layer 2 in the direction of both ends. The step portion includes the lateral surface 2*a*, the end surface 2*c*, and the horizontal surface 2*b*.

The gap retainer 5 is fixed in a manner such that the gap retainer 5 fits into the fixing groove 1*a* of the conductive supporting member 1, contacting at least two surfaces constituting the step portion of the electrical resistance adjusting layer 2.

When the gap retainer 5 is fixed as described above, displacement of the conductive supporting member 1 and the electric adjusting layer 2 can be reduced, if not prevented entirely. Accordingly, the shape of the conductive member 10 is less affected by a change in ambient conditions and long-term use.

Furthermore, when there is a change in the dimensions of the electrical resistance adjusting layer 2 in the radial direction due to changes in ambient conditions, the circumferential surface of the gap retainer 5 accommodates itself to these changes, thereby making it possible to prevent fluctuation in the size of the gap.

As illustrated in FIG. 8, the gap retainer 5 formed in advance to a desired shape is fitted into the step portion provided in the vicinity of each end of the electrical resistance adjusting layer 2 of the conductive member (charging member) 10. As illustrated in FIGS. 8 and 9, the gap retainer 5 abuts the fixing groove 1*a* of the conductive member 1 and at least two surfaces constituting the electrical resistance adjusting layer 2. Accordingly, the gap retainer 5 is fitted into the fixing groove 1*a*.

Subsequently, by using a cutting tool, for example, a tool bit, both the gap retainer 5 and the electrical resistance adjusting layer 2 are cut substantially simultaneously in one continuous process, thereby forming a difference in height on each outer circumferential surface of the gap retainer 5 relative to the outer circumferential surface of the electric resistance adjusting layer 2. Hence, a highly precise height difference between the surface of the gap retainer 5 and the surface of the electrical resistance adjusting layer 2, such that a variation in height between the surface of the gap retainer 5 and the surface of the electrical resistance adjusting layer 2 of no more than ±10μ can be obtained.

According to the exemplary embodiment described above, the difference in height relative to the circumferential surface of the gap retainer 5 is formed in the circumferential surface of the electrical resistance adjusting layer 2 by cutting and grinding both the gap retainer 5 and the electrical resistance adjusting layer 2 substantially simultaneously in one continuous process. Accordingly, it is possible to reduce fluctuation in the size of the gap G formed between the circumferential surface of the image bearing member 61 and the circumferential surface of the electrical resistance adjusting layer 2, and enhance dimensional accuracy of the gap G.

According to the exemplary embodiment described above, the height of the gap retainer 5 adjacent to the electrical resistance adjusting layer 2 is configured to be substantially the same or lower than the height of the electrical resistance adjusting layer 2. Accordingly, a contact width of the gap retainer 5 in contact with the image bearing member 61 can be reduced and a highly precise gap G can be provided between the conductive member 10 and the image bearing member 61.

Furthermore, it is possible to prevent the circumferential surface of the ends of the gap retainer 5 facing the electrical resistance adjusting layer 2 from contacting the image bearing member 61, making it possible to suppress leak current which is generated when the electrical resistance adjusting layer 2 contacts the image bearing member 61 through the ends of the gap retainer 5.

According to the exemplary embodiment described above, the height of the ends of the gap retainer 5 adjacent to the electrical resistance adjusting layer 2 is formed substantially lower than the outer circumferential surface of the electrical resistance adjusting layer 2 so that an escape portion for the cutting tools during cutting can be provided. Accordingly, as long as the circumferential surface of the ends of the gap retainer 5 does not contact the image bearing member 61, there is no specific restriction on the shape of the escape portion.

According to the exemplary embodiment described above, the shape of the gap retainer 5 is formed in such a manner that the gap retainer 5 covers a region of the electrical resistance adjusting layer 2 from the circumferential surface of the step portion at each end thereof to the side surface of the ends. Accordingly, peeling and pulling or the like of the end portions of the gap retainer 5 due to the stress caused by the cutting tool is less likely to occur, preventing deformation of the shape of the gap retainer 5 and any accompanying fluctuations in the size of the gap G.

When the electrical resistance adjusting layer 2 is merely provided on the conductive supporting member 1 of the conductive member 10, there is a possibility that toner or the like sticks to the electrical resistance adjusting layer 2, and the performance of the conductive member 10 may deteriorate. In view of this, when a surface layer, not shown, is provided to the electrical resistance adjusting layer 2, such a problem may be prevented.

According to the exemplary embodiment described above, the volume resistivity of the surface layer is preferably greater than that of the electrical resistance adjusting layer 2, so that voltage concentration and abnormal discharge into defective portions of the image bearing member 61 may be reduced, if not prevented entirely. However, when the electrical resistance of the surface layer is too high, sufficient charging and transfer abilities are not secured. Therefore, the difference in the electrical resistance between the surface layer and the electrical resistance adjusting layer 2 is preferably less than or equal to $10^3$.

Materials for forming the surface layer may include preferably fluorine resin, silicon resin, polyamide resin, polyester resin, or any other suitable resins. Such resins demonstrate good non-adhesive properties, and are preferable in terms of reduction or prevention of toner adherence.

Furthermore, such resins are electrically insulating, so that it is possible to adjust the electrical resistance of the surface layer by dispersing various conductive materials relative to the resin. The surface layer is formed on the electrical resistance adjusting layer 2 in such a manner that the resin constituting the surface layer is dissolved in an organic solution to prepare a coating composition that is then provided on the electrical resistance adjusting layer 2 by spray coating, dipping, roll coating, or the like. The film-thickness of the surface layer is preferably about 10 to 30 μm.

According to the exemplary embodiment described above, the conductive member 10 is formed to a cylindrical shape so that the conductive member 10 can be rotated.

Accordingly, continuous discharge from any particular portion can be reduced, if not prevented entirely, thereby enhancing the product service life.

According to the exemplary embodiment described above, the conductive member 10 may be a charging member, so that it is possible to charge the surface of the image bearing member 61 without contacting the surface of the image bearing member 61. Consequently, contamination of the conductive member 10 (charging member) can be reduced, if not prevented entirely, and the conductive member 10 can be formed of a relatively hard material. As a result, a highly accurate conductive member 10 can be obtained, and irregular charging can be reduced, if not prevented entirely.

According to the exemplary embodiment described above, the conductive member 10 can be a charging roller. However, without departing from the teachings of the present invention, the conductive member can be a developing roller or a transfer roller.

According to the exemplary embodiment described above, the process cartridge may include the conductive member 10 disposed substantially above the image bearing member position in a non-contact manner. Accordingly, a high-quality image may be obtained consistently, and replacement of the process cartridge is made easy and simple.

Figure 11:
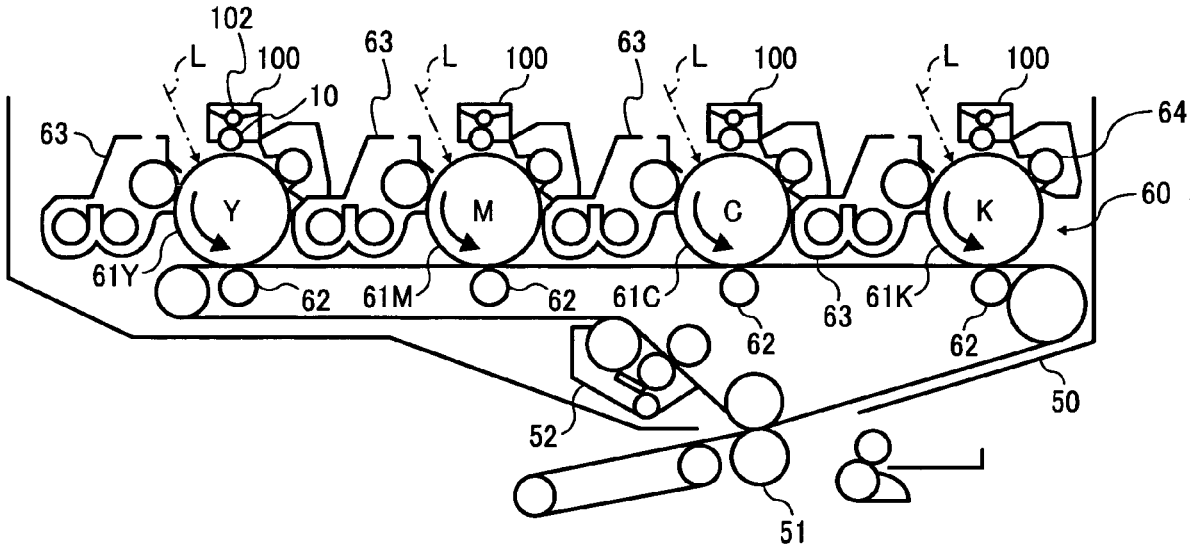
FIG. 11 is an explanatory schematic diagram illustrating an image forming unit of the image forming apparatus of FIG. 10, according to an exemplary embodiment.
Figure 12:
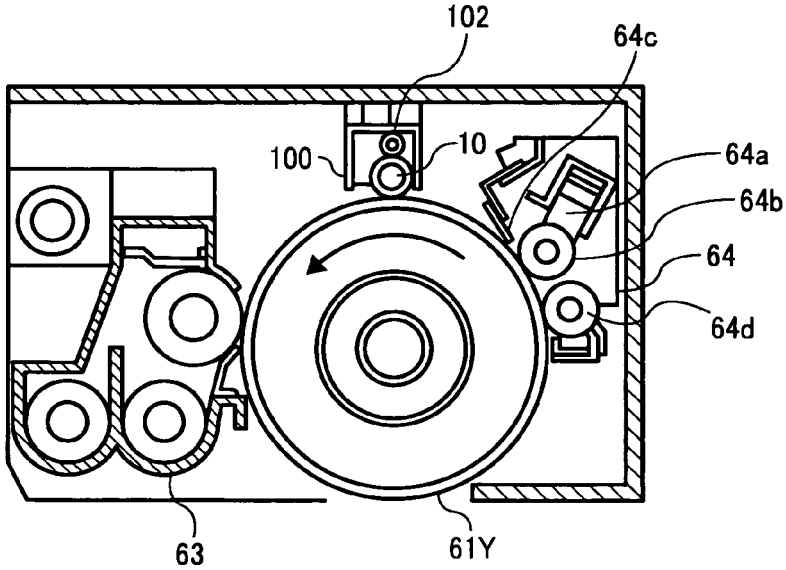
FIG. 12 is an explanatory schematic diagram illustrating a process cartridge according to an exemplary embodiment.

Referring now to FIGS. 11 and 12, a description will be given of the process cartridge implemented in an image forming apparatus 1 according to an exemplary embodiment of the present invention.

FIG. 11 is an explanatory schematic diagram illustrating an image forming unit of the image forming apparatus. FIG. 12 is an explanatory schematic diagram illustrating the process cartridge according to the exemplary embodiment.

It should be noted that a description is given of a process cartridge for yellow as a representative example of the process cartridges. Unless otherwise specified, the structure of other process cartridges for magenta, cyan, and black is similar to, if not the same as, that of the process cartridge for yellow, the only difference being the color of toner.

As illustrated in FIGS. 11 and 12, the process cartridge may include at least the image bearing member 61Y, a charging unit 100, and a cleaning unit 64. Alternatively, the process cartridge may also include a developing unit 63. The process cartridge is detachably mountable relative to the image forming apparatus 1.

In the process cartridge according to the exemplary embodiment of the present invention, the surface of the image bearing member 61Y is uniformly charged by the conductive member 10 serving as the charging member so that the latent image is formed on the image bearing member 61Y. The conductive member 10 is disposed such that the image forming region of the image bearing member 61Y is not in contact with the conductive member 10.

After the latent image is formed, the latent image is developed with toner so that the latent image becomes visible, thereby forming the toner image. The toner image is transferred onto the recording medium.

The toner not having been transferred onto the recording medium and thus remaining on the image bearing member surface is recovered by an auxiliary cleaning member 64*d* in FIG. 12. Subsequently, in order to prevent the toner and materials composing the toner from sticking to the surface of image bearing member 61Y, a solid lubricant 64*a* is applied to the image bearing member 61Y by an applicator 64*b* so that a lubricant film is formed on the image bearing member 61Y. Subsequently, the toner not adequately collected by a cleaning member 64*c* is collected by the auxiliary cleaning member 64*d* and transported to a waste toner bin.

The auxiliary cleaning member 64*d* may be a roller or a brush. The solid lubricant 64*a* may include metal salts of fatty acids including zinc stearate, polytetrafluoroethylene, or any other suitable materials that reduce the friction properties and the viscosity on the image bearing member 61Y.

The cleaning member 64*c* may be a blade formed of silicone, urethane, or any other suitable materials. The cleaning member 64*c* may also be a fur brush including polyester fibers or the like.

The charging unit 100 may include a cleaning member 102 configured to clean the conductive member 10. According to the exemplary embodiment, the cleaning member 102 has a roller shape. However, alternatively the cleaning member 102 may be of a roller type or a pad type.

The cleaning member 102 is rotatively fitted to a shaft bearing provided in a housing, not shown, of the charging unit 100. The cleaning member 102 abuts the conductive member 10 so as to clean the circumferential surface thereof. When foreign material such as paper dust and broken parts stick to the surface of the conductive member 10, the electric field is concentrated on the foreign material, thereby dominantly inducing abnormal discharge.

On the other hand, when electrically insulating foreign material adheres to a wide area, discharge is less likely to occur in the area where the electrically insulating foreign material adheres. Consequently, charge mottles are generated on the image bearing member 61Y. Therefore, it is preferable that the cleaning member 102 configured to clean the surface of the conductive member 10 be provided to the charging unit 100.

The cleaning member 102 may be of a brush formed of polyester fibers or the like, or a porous material (sponge) such as a melamine resin. The cleaning member 102 may rotate at a different linear speed and intermittently separate from the conductive member 10 according to the movement of the conductive member 10.

The charging unit 100 may include a power source to supply voltage to the conductive member 10. The voltage may be a direct current (DC) voltage. However, the voltage may be an alternating current voltage superimposed on the direct current voltage.

When there is unevenness in the layer structure of the conductive member 10 and only direct current (DC) voltage is applied, there is a possibility that the surface potential of the image bearing member 61Y may be substantially nonuniform. When alternating current voltage superimposed on the direct current voltage is applied, the surface of the conductive member 10 may obtain a substantially uniform potential, thereby stabilizing discharge. Accordingly, the image bearing member 61Y can be uniformly charged.

It is preferable that a peak-to-peak voltage of the alternating current voltage superimposed be set to a voltage at least twice as high as an initial charging voltage of the image bearing member 61Y. The initial charging voltage herein refers to an absolute value of the voltage when the image bearing member 61Y starts to be charged when the conductive member 10 is supplied with only the direct current voltage. Accordingly, reverse discharge from the image bearing member 61Y to the conductive member 10 occurs, and thus the image bearing member 61Y can be charged in a more stable manner.

Furthermore, it is preferable that a frequency of the alternating current voltage is set to a frequency 7 times greater than the peripheral speed or the process speed of the image bearing member 61Y to prevent a moiré image from being recognized visually.

According to the exemplary embodiment, a brush roller may be used as the auxiliary cleaning member 64*d*. Zinc stearate may be formed into a block shape and used as a solid lubricant therefor. When the brush roller serving as an applicator is pressed against the solid lubricant by a pressure member, for example, a spring, and scrapes the solid lubricant, the solid lubricant can be applied to the image bearing member 61Y.

The cleaning member 64*c* may be formed of a urethane blade and operates in a counter method in which the cleaning member 64*c* faces an opposing direction to the rotary direction of the image bearing member 61Y.

The cleaning member 102 of the conductive member 10 may be a sponge-type roller formed of a melamine resin, for example, and rotate according to the rotary movement of the conductive member 10 so as to clean the surface of the conductive member 10.

Figure 10:
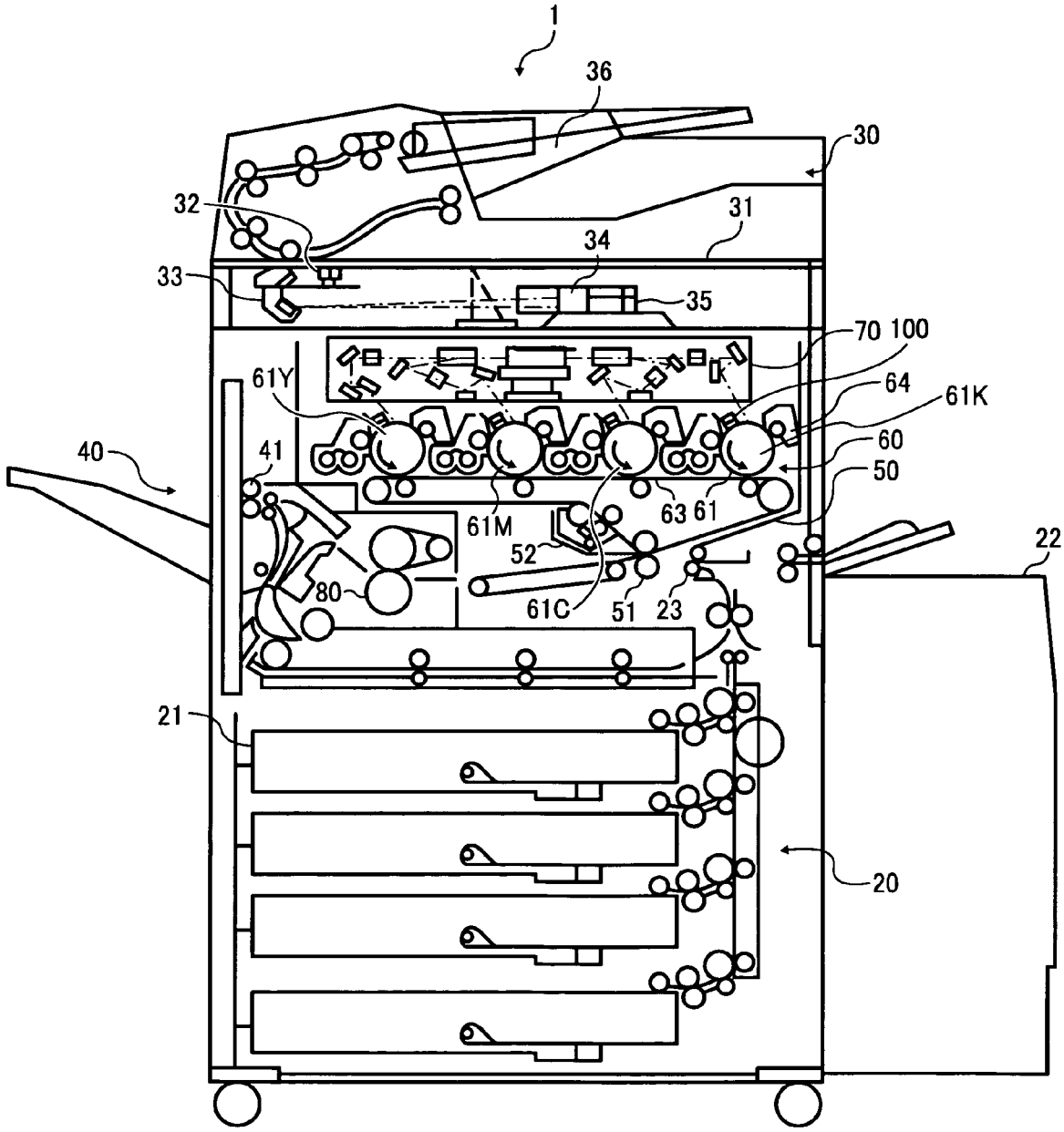
FIG. 10 is a schematic diagram illustrating an image forming apparatus, according to an exemplary embodiment.

With reference to FIG. 10 there is provided schematic diagrams illustrating one example of an image forming apparatus in which the process cartridge according to the present invention may be implemented.

As illustrated in FIGS. 10 and 11, an image forming apparatus 1 may include at least: four drum-type image bearing members 61Y, 61M, 61C, and 61K for four colors, yellow (Y), magenta (M), cyan (C), and black (K), respectively, each including a photoreceptive surface; four charging units 100 each configured to uniformly charge the respective image bearing member 61; an exposure unit 70 configured to expose the charged image bearing members 61Y through 61K with a laser beam L so as to form an electrostatic latent image thereon; four developing units 63 configured to store developers of yellow, magenta, cyan, and black to form toner images corresponding to the electrostatic latent images on the image bearing members 61Y through 61K; four primary transfer units 62 configured to transfer the toner images on the image bearing members 61Y through 61K; a belt-type intermediate transfer member 50 onto which the toner images on the image bearing members 61Y through 61K are transferred; a secondary transfer unit 51 configured to transfer the toner images on the intermediate transfer member 50 onto a recording medium; a fixing unit 80 configured to fix the toner images on the recording medium; and the cleaning units 64 each configured to remove the toner remaining on the respective image bearing member after transfer processing.

The recording medium is stored in sheet feed cassettes 21 of a sheet feed unit 20. The recording medium is transported one by one from one of the sheet feed cassettes 21 to a registration roller 23 by a conveyance roller via a sheet conveyance path. The recording medium is sent to a transfer position in appropriate timing such that the recording medium is aligned with the toner images formed on the image bearing members 61.

The letter symbols Y, M, C, and K denote yellow, magenta, cyan, and black, respectively.

The image bearing members 61Y, 61M, 61C, and 61K charged by the charging units 100 are exposed with the laser beam from the exposure unit 70 of the image forming apparatus 1. Accordingly, the electrostatic latent images are formed on the photoconductive image bearing members 61. The laser beam L may be of a lamp such as a fluorescent light, a halogen lamp, or the like, and a semiconductor element such as an LED, laser diode (LD), or the like. According to the exemplary embodiment, the LD is used when the laser beam L is irradiated in synchrony with rotation of the image bearing members according to a signal from an image processing unit.

The developing units 63 each include a developer bearing member. Toner stored in the developing units 63 is transported to an agitation unit by a supply roller. The developer including carriers and the toner are mixed and agitated in the agitation unit and transported to a developing region facing the image bearing member 61.

The electrostatic latent images on the image bearing members 61Y through 61K are developed with the toner charged to a positive or a negative polarity. The developer may include a magnetic or non-magnetic monocomponent developer. Alternatively, the developer may include a mixture of both, or a liquid developer.

The primary transfer units 62 each form an electric field of a polarity opposite to the polarity of toner at the rear side of the intermediate transfer member 50 so as to transfer the toner images developed on the image bearing members 61Y through 61K to the intermediate transfer medium 50. The primary transfer units 62 may be a corotron or a scorotron corona transfer unit, a roller-type transfer unit, or a brush-type transfer unit.

Subsequently, the toner images are transferred onto the recording medium by the secondary transfer unit 51 in appropriate timing such that the recording medium is transported from the sheet feed unit 22.

Alternatively, the initial transfer process may be performed directly onto the recording medium, rather than using the intermediate transfer medium 50.

The fixing unit 80 fixes the toner images on the recording medium by applying heat and/or pressure. In the image forming apparatus 1, the toner images on the recording medium pass between a pair of pressure and fixing rollers while being heated and pressed. Accordingly, binding resin in the toner is fused with and fixed onto the recording medium.

Alternatively, instead of using the rollers, the fixing unit 80 may be a belt, or a halogen lamp or the like that irradiates heat.

The cleaning units 64 of the image bearing members 61 remove the toner not having been transferred and remaining on the image bearing members 61Y through 61K so as to prepare for the subsequent image forming processing. The cleaning units 64 may use a blade formed of rubber, for example, urethane or the like, or a brush formed of fibers made of polyester or the like.

With reference to FIG. 10, a description will be given of operation of the image forming apparatus 1. A reading unit 30 may include a document conveyance unit 36 including a document table, a contact glass 31, a first reading carriage 32, and a second reading carriage 33.

A document is placed either on the document table of the document conveyance unit 36 or on the contact glass 31 by opening the document conveyance unit 36 and closing the document conveyance unit 36 to hold the document. In a case in which the document is placed on the document conveyance unit 36, when a switch, not shown, for starting the operation is pressed, the document is transported onto the contact glass 31, and the first reading carriage 32 and the second reading carriage 33 start scanning the document. When the document is placed on the contact glass 31, the first reading carriage 32 and the second reading carriage 33 immediately start scanning.

Light is emitted from a light source of the first reading carriage 32 while the light reflected on the document surface is further reflected toward the second reading carriage 33. Subsequently, the light is reflected by a mirror of the second reading carriage 33 to a CCD 35 serving as a reading sensor through an imaging lens 34. Accordingly, image information is read.

The image information read by the CCD 35 is sent to a control unit. The control unit enables the LD or LED, not shown, disposed in the exposure unit 70 of an image forming unit 60 to irradiate the image bearing members 61 with a laser beam L for writing based on the image information received from the reading unit 30. Accordingly, the electrostatic latent images are formed on the surface of the image bearing members 61Y through 61K.

In the sheet feed unit 20, the recording medium is taken from the appropriate sheet feed cassette 21 among a plurality of the sheet feed cassettes 21 by a sheet feed roller. The recording medium is separated by a separation roller and sent to a sheet feed path in the image forming unit 60 by the conveyance roller.

In addition to automatically feeding the recording medium in the sheet feed unit 20, the recording medium can be manually fed. The image forming apparatus 1 may further include a manual sheet feed tray configured to manually feed the recording medium and a separation roller provided at the side surface of the image forming apparatus configured to separate the recording medium from the manual sheet feed tray one by one and send it to a manual sheet feed path.

The registration roller 23 ejects the recording medium placed on the sheet feed cassette 21 one sheet at a time and sends the recording medium to a position, that is, the secondary transfer portion, between the intermediate transfer member 50 and the secondary transfer unit 51.

In the image forming unit 60, when the image information is received from the reading unit 30, the above-described optical writing and the developing process are performed to create an electrostatic latent image on the image bearing members 61Y through 61K.

The developer in the developing units 63 is drawn and held by a magnetic pole, not shown, thereby forming a magnetic brush on the developer bearing member. Furthermore, a developing bias voltage in which alternating current (AC) voltage and direct current (DC) voltage are superimposed is applied to the developer bearing member and causes the developer to move to the image bearing members 61 so that the electrostatic latent images on the image bearing members 61 are made visible to form toner images.

Subsequently, one of the sheet feed rollers of the sheet feed unit 20 is activated to feed the recording medium of an appropriate size corresponding to the toner image. A drive motor rotatively drives one of the supporting rollers while other two supporting rollers (driven rollers) are rotated, enabling the intermediate transfer member 50 to rotate. In the meantime, each image bearing member 61 is rotated in the respective image forming unit, and images of different colors, that is, of yellow, magenta, cyan, and black, are formed on the respective image bearing members 61.

Subsequently, along with the movement of the intermediate transfer member 50, the toner images of different colors are sequentially transferred onto the intermediate transfer member 50, thereby forming a composite toner image.

In the sheet feed unit 20, the appropriate sheet feed roller is selected to feed the recording medium from the one of the sheet feed cassettes 21. The separation roller separates the recording medium from the sheet feed cassette 21 one sheet at a time and sends it to the sheet feed path. The conveyance roller guides the recording medium to the sheet feed path in the image forming unit 60 of the image forming apparatus 1. The recording medium contacts the registration roller 23 and stops.

The registration roller 23 starts to rotate in appropriate timing such that the recording medium is aligned with the composite toner image formed on the intermediate transfer member 50. More specifically, the recording medium is sent to the secondary transfer portion where the intermediate transfer member 50 and the secondary transfer unit 51 are in contact so that the secondary transfer bias formed in the secondary transfer portion and pressure are applied to the toner image. Accordingly, the toner image is secondarily transferred to and recorded on the recording medium.

It is preferable that the secondary transfer bias be alternating current.

After the image is transferred onto the recording medium, the recording medium is transported to the fixing unit 80 by the conveyance belt of the secondary transfer unit 51. In the fixing unit 80, the recording medium is heated and pressed by the pressure roller so that the toner image is fixed thereon. After the toner image is fixed, the recording medium is ejected by a sheet discharge roller 41 onto a catch tray 40.

According to the exemplary embodiment described above, the image forming apparatus 1 may include the above-described process cartridge in which the conductive member serving as a charging member is disposed in such a manner that the conductive member is not in contact with the surface of the image bearing member as illustrated in FIG. 12.

Accordingly, it is possible to consistently obtain high-quality images for an extended period of time. Furthermore, replacement and maintenance can be performed with ease. Moreover, when the process cartridge of the exemplary embodiment is included in the image forming apparatus 1, reliability can be enhanced.

The exemplary embodiments of the present invention are described and compared with comparative examples below.

Exemplary Embodiment 1

An exemplary conductive member was produced in the following manner: A resin composition (the volume resistivity of $2\times10^8$ Ω·cm) including 50 wt % of ABS resin (Denka ABS GR-0500, manufactured by Denki Kagaku Kogyo Co.) and 50 wt % of polyester ester amide (IRGASTAT P18, manufactured by Chiba Specialty Chemicals) was molded into a pipe shape by injection molding.

A conductive supporting member (core shaft) formed of stainless steel and having an external diameter of 8 mm was inserted into the pipe-shape resin composition so as to form an electrical resistance adjusting layer having an external diameter of 14 mm on the conductive supporting member and an external diameter of 11.3 mm for a step portion at both ends. A fixing groove was provided at both ends of the conductive supporting member. A thickness of the fixing groove in section B was 2 mm as shown in FIG. 6A, and a thickness of the fixing groove in section D was 0.5 mm.

Subsequently, a cap-shape gap retainer was press-fitted onto the step portion at both ends of the electrical resistance adjusting layer. The gap retainer was formed of high-density polyethylene resin (Novatech PP HY540, manufactured by Japan Polychem) and included an opening through which the conductive supporting member was inserted. The electrical resistance adjusting layer, the gap retainer, and the conductive supporting member were fitted and bonded in a manner such that the opening of the gap retainer was fitted with the fixing groove at both ends of the conductive supporting member.

Subsequently, the surface of the gap retainer and the electrical resistance adjusting layer were simultaneously finished by cutting so as to form the external diameter (the maximum diameter) of the gap retainer to approximately 12.12 mm and the external diameter of the electrical resistance adjusting layer to approximately 12.00 mm, and the gap retainer was formed to a thickness of 0.4 mm in section A, a thickness of 2 mm in section B, and a width of 8 mm in section C.

Subsequently, a surface layer having a thickness of approximately 10 μm was formed by spray-coating the surface of the electrical resistance adjusting layer with a resin composition (the surface resistance of $2\times10^{10}\Omega$) including acryl silicone resin (3000 VH-P, manufactured by Kawakami Toryo Co.), isocyanate-based curing agent, and carbon black (30 wt % with respect to the total solid component). Subsequently, the coated resin was heated and cured in an oven at 80 degrees C. for approximately 1 hour. Accordingly, the conductive member was obtained.

Exemplary Embodiment 2

The conductive member of the exemplary embodiment 2 was obtained in a substantially similar manner as the conductive member of the exemplary embodiment 1, except that the external diameter of the step portion at both ends of the electrical resistance adjusting layer was 11.1 mm and the thickness of the gap retainer in section A was 0.5 mm.

Exemplary Embodiment 3

The conductive member of the exemplary embodiment 3 was obtained in a substantially similar manner as the conductive member of the exemplary embodiment 1, except that the external diameter of the step portion at both ends of the electrical resistance adjusting layer was 10.9 mm and the thickness of the gap retainer in section A was 0.6 mm.

Exemplary Embodiment 4

The conductive member of the exemplary embodiment 4 was obtained in a substantially similar manner as the conductive member of the exemplary embodiment 1, except that the fixing groove in section B was 1.5 mm; the external diameter of the step portion at both ends of the electrical resistance adjusting layer was 10.9 mm; the thickness of the gap retainer in section A was 0.5 mm; the thickness of the gap retainer in section B was 1.5 mm; and the width of the gap retainer in section C was 7.5 mm.

Comparative Example 1

A core shaft formed of stainless steel having an external diameter of 8 mm was coated with a rubber composition (the volume resistivity $4\times10^{8}$ Ω·cm) as an electrical resistance adjusting layer including 100 parts by weight of epichlorohydrin rubber (Epichlomer CG, manufactured by Daiso) blended with 3 parts by weight of ammonium perchlorate by injection molding and vulcanization processing. Subsequently, the electrical resistance adjusting layer was finished to an external diameter of 12 mm by grinding.

Subsequently, a surface layer having a film thickness of 10 μm was formed on the electrical resistance adjusting layer. The surface layer was formed of a mixture (the surface resistance $2\times10^{10}\Omega$) including polyvinylbutylal resin (Denka butylal 3000-K, manufactured by Denki Kagaku Kogyo, Co.), isocyanate-based curing agent, and tin oxide (60 wt % with respect to the total solid component). Then, a ring-shape gap retainer formed of polyamide resin (Novamide 1010C2, manufactured by Mitsubishi Engineering Plastics) having an external diameter of 12.1 mm was fitted and bonded to both end portions of the surface layer. Accordingly, the conductive supporting member was produced.

Comparative Example 2

A core shaft formed of stainless steel having an external diameter of 8 mm was coated with a rubber composition (the volume resistivity of $4\times10^{8}$ Ω·cm) as an electrical resistance adjusting layer including 100 parts by weight of epichlorohydrin rubber (Epichlomer CG, manufactured by Daiso) blended with 3 parts by weight of ammonium perchlorate by injection molding and vulcanization. Subsequently, the electrical resistance adjusting layer was finished to an external diameter of 12 mm by grinding.

Subsequently, a surface layer having a thickness of 10 μm was formed on the electrical resistance adjusting layer. The surface layer was formed of a mixture (the surface resistance $2\times10^{10}\Omega$) including polyvinylbutylal resin (Denka butylal 3000-K, manufactured by Denki Kagaku Kogyo, Co.), isocyanate-based curing agent, and tin oxide (60 wt % with respect to the total solid component). Then, the circumference of both ends of the surface layer was covered with a tape-shaped member (Daitac PF025-H, manufactured by Dai Nippon Ink Co.) having a width of 8 mm and a thickness of 60 μm.

Comparative Example 3

A resin composition (the volume resistivity $2\times10^{8}$ Ω·cm) including 50 wt % of ABS resin (Denka ABS GR-0500, manufactured by Denki Kagaku Kogyo Co.) and 50 wt % of polyester ester amide (IRGASTAT P18, manufactured by Chiba Specialty Chemicals) was molded to a pipe shape by injection molding so as to form an electrical resistance adjusting layer. Subsequently, a core shaft formed of stainless steel having an external diameter of 8 mm was inserted to the pipe-shape resin composition to form the electrical resistance adjusting layer having an external diameter of 14 mm and an external diameter of 11.3 mm for a step portion at both ends.

Figure 2:
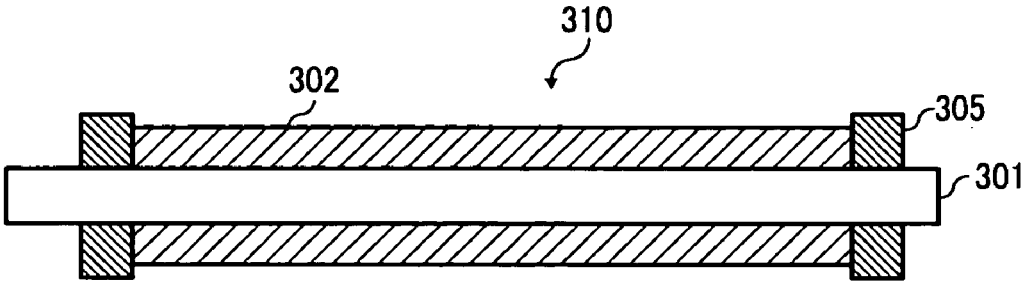
FIG. 2 PRIOR ART
FIG. 2 is a cross-sectional view illustrating the charging member of FIG. 1.
Figure 3:
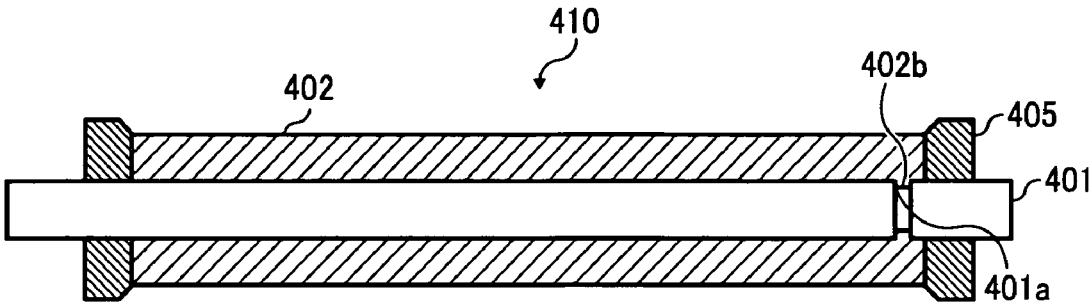
FIG. 3 PRIOR ART
FIG. 3 is a cross-sectional view illustrating another related art charging member (charging roller)
Figure 4:
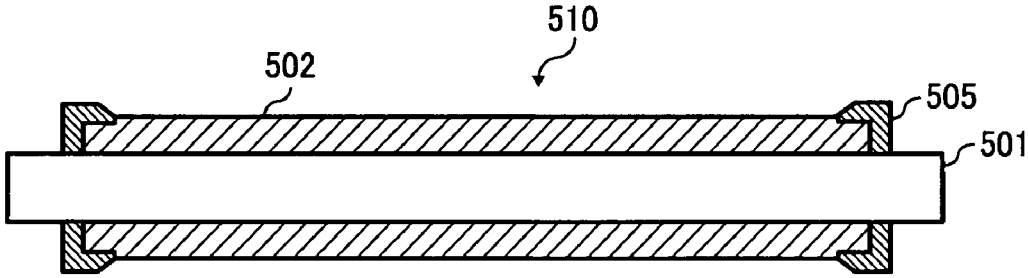
FIG. 4 PRIOR ART
FIG. 4 is a cross-sectional view illustrating still another related art charging member (charging roller)

A ring-shape gap retainer formed of polyamide resin (Novamide 1010C2, manufactured by Mitsubishi Engineering Plastics) was fitted and bonded on both ends of the electrical resistance adjusting layer. The surface of the gap retainer and the electrical resistance adjusting layer were simultaneously finished by cutting so as to form the external diameter (the maximum diameter) of the gap retainer to be approximately 12.1 mm and the external diameter of the electrical resistance adjusting layer to be approximately 12.0 mm, the structure of which is similar to the structure shown in FIG. 2.

Subsequently, a surface layer having a thickness of 10 μm was formed on the electrical resistance adjusting layer. The surface layer was formed of a mixture (the surface resistance $2\times10^{10}\Omega$) including polyvinylbutylal resin (Denka butylal 3000-K, manufactured by Denki Kagaku Kogyo, Co.), isocyanate-based curing agent, and tin oxide (60 wt % with respect to the total solid component).

Each of the conductive members obtained from the embodiments 1 through 4 and the comparative examples 1 through 3 was installed in the image forming apparatus 1 illustrated in FIG. 10.

The length of the conductive member and the size of the gap between the conductive member and the image bearing member were measured at normal room ambient (23 degrees C., 60% RH). Subsequently, the image forming apparatus was left for 24 hours in a low-temperature-low-humidity (LL) condition (10 degrees C., 65% RH) and a high-temperature-high-humidity (HH) condition (30 degrees C., and 90% RH). The length of the conductive member and the size of the gap between the conductive member and the image bearing member were measured under all conditions.

Evaluation results are shown in FIG. 13. In FIG. 13, "GOOD" indicates that a fluctuation amount of the length of the conductive member was less than or equal to 0.1 mm, and a fluctuation amount of the size of the gap was less than or equal to 0.01 mm, between the three different environments consisting of the normal room ambient, the LL condition (10 degrees C., 65% RH) and the HH condition (30 degrees C., and 90% RH). "BAD" indicates that the fluctuation amount of the length of the conductive member was greater than 0.1 mm or the fluctuation amount of the size of the gap was greater than 0.01 mm between the different environments: the normal room ambient, the LL condition (10 degrees C., 65% RH) and the HH condition (30 degrees C., and 90% RH).

As, can be seen in FIG. 13, when using the conductive members according to the exemplary embodiments 1 through 4, the amounts of fluctuation in the length of the conductive members and the size of the gap were smaller than the amounts of fluctuation in the length of the conductive members and the size of the gap using the conductive members according to the comparative examples 1 through 3.

Furthermore, evaluations were made with respect to the size of the gap, the surface condition of the conductive members (charging rollers), and images, when a DC voltage of −800 V and an AC voltage of 2400 Vpp (frequency=2 kHz) were supplied and 600,000 sheets were processed. The evaluation results are shown in FIG. 14.

The evaluating conditions were switched between the normal room ambient (23 degrees C., 65% RH), the low-temperature-low-humidity (LL) condition (10 degrees C., 65% RH), and the high-temperature-high-humidity (HH) condition (30 degrees C., and 90% RH) after every 10,000 sheets.

In FIG. 14, "GOOD" indicates that unevenness of an image was not recognized in an initial image and the image after 600,000 sheets were processed. "BAD" indicates that unevenness of an image was recognized in the initial image and/or the image after 600,000 sheets were processed.

As can be seen in FIG. 14, when using the conductive members according to the exemplary embodiments 1 through 4, the optimum image was obtained. On the other hand, unevenness of an image was recognized in either the initial image or the image after 600,000 sheets were processed, or both images, using the conductive members according to the comparative examples 1 though 3.

Elements and/or features of different exemplary embodiments may be combined with each other and/or substituted for each other within the scope of this disclosure and appended claims.

The number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system. For example, of the aforementioned methods may be embodied in the form of a system or device, including, but not limited to, any of the structure for performing the methodology illustrated in the drawings.

Example embodiments being thus described, it will be obvious that the same may be varied in many ways. Such exemplary variations are not to be regarded as a departure from the spirit and scope of the present invention, and all such modifications as would be obvious to one skilled in the art are intended to be included within the scope of the following claims.

What is claimed is:

1. A conductive member, comprising:

a conductive supporting member, provided facing an image bearing member and including a continuous or discontinuous fixing groove provided in the vicinity of each of both ends of the conductive supporting member in a peripheral direction thereof;

an electrical resistance adjusting layer, formed on the conductive supporting member and including a step portion including at least one step disposed in the vicinity of each of the both ends of the electrical resistance adjusting member; and cap-shape gap retainers each provided to the step portion, the gap retainers each including a cylinder portion configured to contact at least one surface of the step portion and an end plate including a hole in a substantially center thereof through which the conductive supporting member is inserted, the end plate configured to contact at least one surface of the step portion and fit into the fixing groove, wherein each gap retainer is fitted into the step portion such that a difference in height relative to a circumferential surface of the electric resistant adjusting layer is formed in a circumferential surface of the gap retainer so as to form a predetermined gap between a circumferential surface of the image bearing member and the circumferential surface of the electrical resistance adjusting layer.

2. The conductive member according to claim 1, wherein the cylinder portion of the gap retainer is fitted to the step portion by press fitting.

3. The conductive member according to claim 1, wherein an adhesive agent fixes the gap retainer to at least one of the electrical resistance adjusting layer and the conductive supporting member.

4. The conductive member according to claim 3, wherein the gap retainer is fixed to at least one of the electrical resistance adjusting layer and the conductive supporting member by adhesive agent through primer applied to the gap retainer.

5. The conductive member according to claim 1, wherein at least a portion of the gap retainer, which contacts the image bearing member, includes an electrically insulating resin material.

6. The conductive member according to claim 5, wherein a volume resistivity of the gap retainer is greater than or equal to $10^{13}\Omega\cdot$cm.

7. The conductive member according to claim 1, wherein a volume resistivity of the electric resistant adjusting layer is in a range of from $10^6\Omega\cdot cm$ to $10^9\Omega\cdot cm$.

8. The conductive member according to claim 1, wherein the difference in height relative to the circumferential surface of the electric resistant adjusting layer is formed in the circumferential surface of the gap retainer by cutting and grinding both the circumferential surface of the gap retainer disposed on the conductive supporting member and the electric resistant adjusting layer disposed on the conductive supporting member substantially simultaneously in a single continuous process.

9. The conductive member according to claim 1, wherein a surface layer is formed on the electric resistant adjusting layer.

10. The conductive member according to claim 9, wherein a volume resistivity of the surface layer is greater than the volume resistivity of the electric resistant adjusting layer.

11. The conductive member according to claim 1, wherein the conductive member has a cylindrical shape.

12. The conductive member according to claim 1, wherein the conductive member is a charging member.

13. A process cartridge, comprising:

an image bearing member configured to bear an electrostatic latent image on a surface thereof;

a cleaning unit configured to clean toner remaining on the surface of the image bearing member; and a charging member serving as a conductive member disposed in the vicinity of a device to charge, the charging member including a conductive supporting member, provided facing an image bearing member and including a continuous or discontinuous fixing groove provided in the vicinity of each of both ends of the conductive supporting member in a peripheral direction thereof;

an electrical resistance adjusting layer, formed on the conductive supporting member and including a step portion including at least one step disposed in the vicinity of each of the both ends of the electrical resistance adjusting member; and cap-shape gap retainers each provided to the step portion, the gap retainers each including a cylinder portion configured to contact at least one surface of the step portion and an end plate including a hole in a substantially center thereof through which the conductive supporting member is inserted, the end plate configured to contact at least one surface of the step portion and fit into the fixing groove, wherein each gap retainer is fitted into the step portion such that a difference in height relative to a circumferential surface of the electric resistant adjusting layer is formed in a circumferential surface of the gap retainer so as to form a predetermined gap between a circumferential surface of the image bearing member and the circumferential surface of the electrical resistance adjusting layer.

14. An image forming apparatus, comprising:

an image bearing member configured to bear an electrostatic latent image on a surface thereof;

an exposure unit configured to irradiate the image bearing member with a laser beam to form the electrostatic latent image thereon;

a developing unit configured to develop the electrostatic latent image with toner to form a toner image;

a transfer unit configured to transfer the toner image onto a recording medium;

a fixing unit configured to fix the toner image on the recording medium; and a process cartridge including an image bearing member configured to bear an electrostatic latent image on a surface thereof;

a cleaning unit configured to clean toner remaining on the surface of the image bearing member; and a charging member serving as a conductive member disposed in the vicinity of a device to charge, the charging member including a conductive supporting member, provided facing an image bearing member and including a continuous or discontinuous fixing groove provided in the vicinity of each of both ends of the conductive supporting member in a peripheral direction thereof;

an electrical resistance adjusting layer, formed on the conductive supporting member and including a step portion including at least one step disposed in the vicinity of each of the both ends of the electrical resistance adjusting member; and cap-shape gap retainers each provided to the step portion, the gap retainers each including a cylinder portion configured to contact at least one surface of the step portion and an end plate including a hole in a substantially center thereof through which the conductive supporting member is inserted, the end plate configured to contact at least one surface of the step portion and fit into the fixing groove, wherein each gap retainer is fitted into the step portion such that a difference in height relative to a circumferential surface of the electric resistant adjusting layer is formed in a circumferential surface of the gap retainer so as to form a predetermined gap between a circumferential surface of the image bearing member and the circumferential surface of the electrical resistance adjusting layer.

* * * * *